US005516995A

United States Patent [19]

Whitlow et al.

[11] Patent Number: 5,516,995

[45] Date of Patent: May 14, 1996

[54] ELECTRICAL CONTACT COMPOSITIONS AND NOVEL MANUFACTURING METHOD

[75] Inventors: Graham A. Whitlow, Murrysville; William R. Lovic, New Kensington; Paul G. Slade, Pittsburgh, all of Pa.

[73] Assignee: Eaton Corporation, Cleveland, Ohio

[21] Appl. No.: 220,129

[22] Filed: Mar. 30, 1994

[51] Int. Cl.[6] ..... H01H 1/02

[52] U.S. Cl. ..... 200/266

[58] Field of Search ..... 200/266

[56] References Cited

U.S. PATENT DOCUMENTS 4,457,780 7/1984 Osada et al. ..... 200/266 X

*Primary Examiner*—Renee S. Luebke

*Attorney, Agent, or Firm*—Martin J. Moran

[57] ABSTRACT

A new class of low chop contact materials based on Ag-chromium carbide and Ag-Cr compositions have an essentially 100% dense, porosity free microstructure. These materials combine the advantageous properties of Ag-WC and Cu-Cr contacts without their disadvantages. A method of making this new class of low chop contact materials includes the steps of cold pressing a mixture of Ag and chromium or chromium carbide to form an unsintered blank and the elevated temperature infiltration of silver into the unsintered blank to obtain an essentially 100% dense, porosity free microstructure.

5 Claims, 1 Drawing Sheet

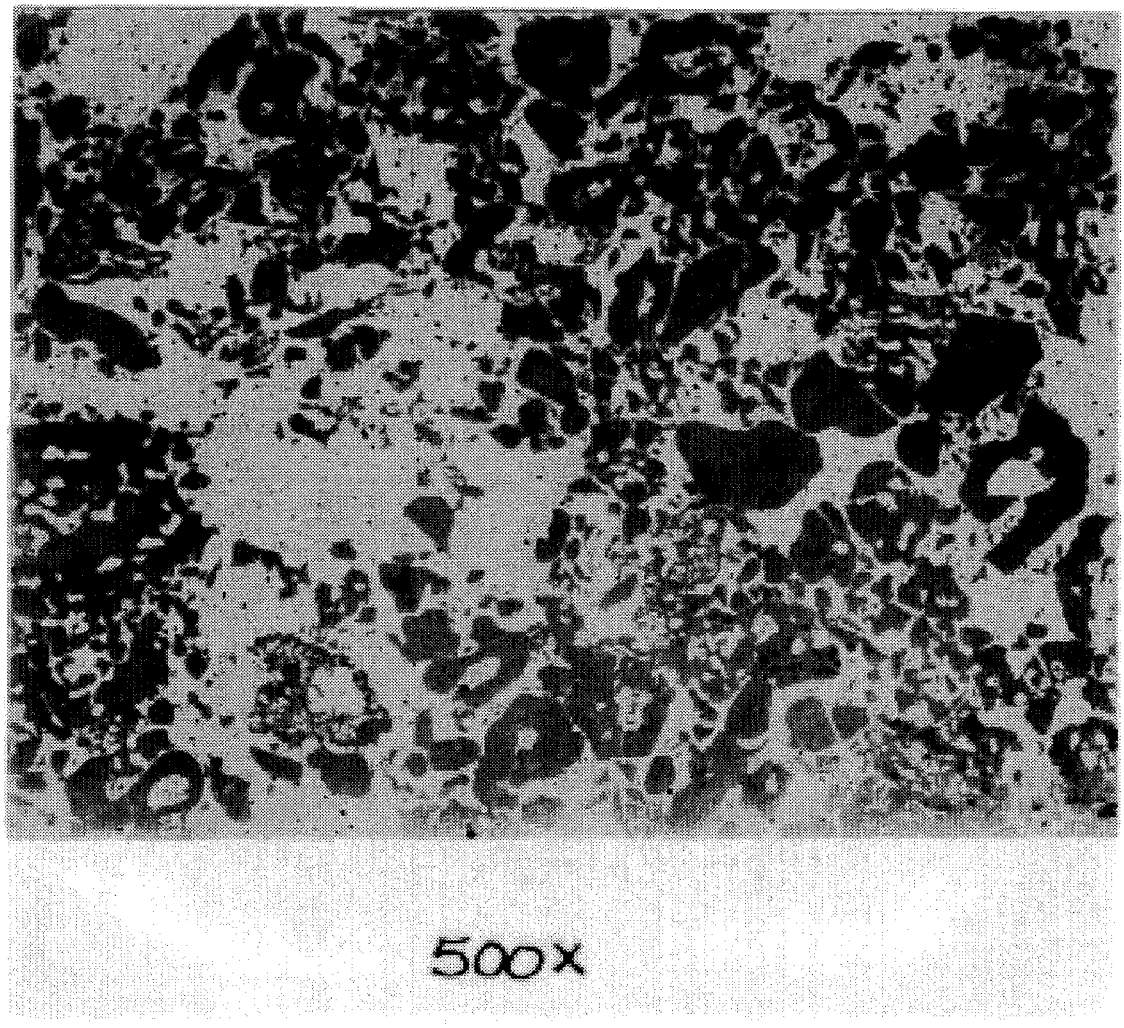
500X

ELECTRICAL CONTACT COMPOSITIONS AND NOVEL MANUFACTURING METHOD

BACKGROUND OF THE INVENTION

Field of the Invention

This disclosure relates generally to electrical contacts for use in vacuum interrupters that are used for power interruption and control devices, and more particularly concerns an improvement in the compositions of these contact materials and a novel manufacturing method for the fabrication of such contacts.

BACKGROUND INFORMATION

The basic contact and its arrangement in a vacuum interrupter, upon which this invention is an improvement, are well known in the art. The contact material is critical to the successful operation of the vacuum interrupter. As the contacts separate, an electric arc is formed between the contacts. This arc, called a vacumm arc, burns in metal vapor evaporated from the contacts themselves at the arc roots.

In an alternating current (ac) circuit where the current follows a sinusoidal wave form to a natural current zero, the energy deposited at the contacts decreases as the current decreases. With a reduction in the energy input to the contact there is a corresponding reduction in the evaporation of the contact material needed to sustain the vacuum arc. A critical property of contact materials used in vacuum interrupters is the current at which there is no longer enough metal vapor to sustain the vacuum arc and it spontaneously extinguishes before the natural current zero. This current is called the "chop current". If the chop current has a high value, the resultant high rate of change of current can cause high voltages in the rest of the circuit. This is especially true if the circuit contains a highly inductive load such as an electric motor.

Contact compositions have been developed to produce low chop currents in vacuum interrupters to be used in inductive circuits such as motor circuits. Two well-known contact materials are Ag-WC and the preferred high current, vacuum interrupter, contact material Cu-Cr, containing a small percentage of Bi. Each of these materials relies on a higher vapor pressure material. For example, Ag in the Ag-WC system and Bi in the Cu-Cr-Bi system provide enough metal vapor for the arc to burn to very low values of current, for example, the order of 1A or less.

Both of these contact materials have major disadvantages. The AgWC materials interrupt currents lower than about 3500A to 4000A very reliably. However, at higher current the heating of the WC causes it to become a thermonic emitter of electrons and its current interruption performance decreases rapidly as the current is increased. The Cu-Cr-Bi material operates well at high currents. Unfortunately, when large percentages of Bi are used, the reactivity of Bi vapor with other materials results in manufacturing difficulties especially in the high temperature vacuum furnaces used to manufacture the complete vacuum interrupters. Bi vapor can react with and destroy the braze materials used to seal the vacuum interrupters, and they can even destroy the furnace metal windings and vacuum furnace linings.

SUMMARY OF THE INVENTION

A novel and improved electrical contact material has been developed comprising an alloy of silver and a material selected from the group consisting of chromium carbide and chromium. The chromium carbide is selected from the group consisting of $Cr_3C_2$, $Cr_7C_3$ and $Cr_{23}C_6$ and mixtures or blends of these three carbides. An effective amount of a ternary element selected from the group consisting of bismuth, tellurium and thallium can also be added to the alloy if required to enhance the are sustaining vapor. The desired electrical composition is formed by adding about 0.10 to 0.99% by weight of the ternary element to the alloy. An effective amount of cobalt may also be added to the desired electrical composition to improve its wetting properties and enhance its essentially 100% dense, porosity free microstructure. The effective amount of cobalt is about 0.5 to 2.5% by weight. The alloy comprises about 50 to 60% by weight silver and about 40 to 50% by weight $Cr_3C_2$ or 50 to 60% by weight silver and 40 to 50% by weight Cr.

The contact has an essentially 100% dense, porosity free microstructure. The use of Ag in the alloy enhances arc vapor due to higher vapor pressure of Ag compared to Cu at a given temperature. The operation of the contact can be accomplished at lower current due to the lower thermal conductivity of chromium carbide.

The method of making this contact comprises the two step process of cold pressing an unsintered blank and elevated temperature infiltration of silver into the unsintered blank to obtain an essentially 100% dense, porosity free microstructure. The blank is formed by blending about 50 to 60% by weight silver powder and a powdered material selected from the group consisting of about 40 to 50% by weight $Cr_3C_2$, $Cr_7C_3$, $Cr_{23}C_6$ and Cr, treating the blended powder mass with hydrogen to precoat/presinter the blended powder mass, granulating the blended powder mass and passing it through a mesh screen, reblending the blended powder mass and shaping it into solid blanks. The first blending preferably uses a V-shaped blender with an intensifier bar and is carried out for about 30 to 50 minutes, preferably 45 minutes. The hydrogen treatment to precoat/presinter the blended powder mass is carried out at about 900° to 1100° C. for about 40 to 55 minutes, preferably at 1000° C. for 45 minutes. The granulated powder mass is passed through a screen of about 15 to 25 mesh, preferably a 20 mesh screen. The porous blank is, for example, about 80 to 85% of the theoretical density for a Ag-$Cr_3C_2$ alloy and about 87 to 93% of the theoretical density for a Ag-Cr alloy. The silver infiltration takes place in a hydrogen furnace for about 1000° to 1200° C. for about 30 minutes to 1½ hours, preferably 1100° C for 1 hour. Infiltration with silver produces an essentially 100% dense, porosity free microstructure by diffusion of liquid Ag through the interconnected porosity within the pressed, unsintered blank.

Therefore, it is an object of the invention to present a new class of low chop contact materials made by a press and infiltration two-step process for use in vacuum interrupters that combine the excellent low chop characteristics of Ag-WC and Cu-Cr-Bi but do not possess their disadvantages.

It is also an object of this invention that the new class of low chop contact materials will interrupt higher currents that can be used with Cu-Cr-Bi and that can easily be processed in high temperature vacuum or hydrogen furnaces.

It is another object of the invention that the new class of low chop contact materials will facilitate breakage of any welds resulting from arcing between contact surfaces as the contacts close because stresses or forces required to break such welds will be low.

It is another object of the invention that these new class of low chop contact materials will sustain an arc for a longer than the usual time due to the high vapor pressure of silver compared to copper for more efficient current transfer and vacuum interrupter operation.

It is still another object of the invention to enable the vacuum operation to be accomplished at lower currents due to the lower thermal conductivity of chromium carbide.

It is yet another object of this invention that the new class of low chop contact materials will permit application at both medium and low voltage.

BRIEF DESCRIPTION OF THE DRAWINGS

A full understanding of the invention can be appreciated from the following detailed description of the invention when read with reference to the accompanying figure.

The figure is a photomicrograph at 500X magnification of a silverchromium carbide contact microstructure with its essentially 100% dense, porosity free microstructure.

DESCRIPTION OF THE PREFERRED EMBODIMENT

A novel and improved electrical contact material comprises an alloy of silver and a material selected from the group consisting of chromium carbide and chromium. The chromium carbide is selected from the group consisting of $Cr_3C_2$, $Cr_7C_3$ and $Cr_{23}C_6$. An effective amount of a ternary element selected from the group consisting of bismuth, tellurium and thallium may also be added to the alloy to enhance an arc sustaining vapor. The effective amount is less than 1% by weight and a desired electrical composition may be formed by adding about 0.10 to 0.99% by weight of the ternary element to the alloy during the blending process. If the ternary element is kept below 1% by weight, a high temperature vacuum furnace can be used for manufacturing. An effective amount of cobalt may be added during the blending process to the electrical composition to improve its wetting properties and enhance its essentially 100% dense, porosity free microstructure. The effective amount of cobalt is about 0.5 to 2.5% by weight, preferably about 1 to 2%. The alloy comprises about 50 to 60% by weight silver and about 40 to 50% by weight $Cr_3C_2$ or Cr, preferably about 58% Ag and about 42% $Cr_3C_2$, or preferably about 50% Ag and about 50% Cr.

The contact has an essentially 100% dense, porosity free microstructure. The use of Ag in the alloy enhances arc vapor due to the higher vapor pressure of Ag compared to Cu. The operation of the contact can be accomplished at lower current due to the lower thermal conductivity of chromium carbide combined with the high vapor pressure of Ag. The arc bums in the metal vapor evaporated from the contacts. A higher vapor pressure material causes evaporation of the metal at lower currents. The low thermal conductivity of the chromium carbide retains heat longer and gives it out slowly to the Ag, allowing for the Ag metal vapor to support the arc. After arcing, the Cr or chromium carbide becomes finely dispersed in the stirface and the surface becomes a brittle skin over the original contact structure facilitating breakage of any weld resulting from arcing between contact surfaces.

The method of making this contact is a two step process of cold pressing an unsintered blank and the elevated temperature infiltration of silver into the unsintered blank to obtain an essentially 100% dense, porosity free microstructure. The method further comprises blending silver and a material selected from the group consisting of $Cr_3C_2$, $Cr_7C_3$, $Cr_{23}C_6$ and Cr, treating the blend with hydrogen to precoat/presinter a blended powder mass, granulating the blended powder mass and passing it through a mesh screen, reblending the blended powder mass in a V-shape blender and shaping it into solid blanks. The first blending uses an intensifier bar and takes about 30 to 50 minutes, preferably 45 minutes. The hydrogen treatment to precoat/presinter the blended powder mass occurs at about 900° to 1100° C. for about 40 to 55 minutes, preferably at 1000° C. for 45 minutes. The granulated powder mass is passed through a screen of about 15 to 25 mesh. The porous blank is about 80 to 90% of the theoretical density for a Ag-$Cr_3C_2$ alloy and about 87 to 93% of the theoretical density for a Ag-Cr alloy. The silver infiltration takes place in a hydrogen furnace for about 1000° to 1200° C. for about 30 minutes to 1½ hours, preferably at 1100° C. for 1 hour. Infiltration with silver produces an essentially 100% dense, porosity free microstructure.

Example 1

An improved electrical contact comprising about a nominal 58% by weight silver and 42% by weight $Cr_3C_2$ was made by the following method. 1224 grams of silver powder and 1176 grams of $Cr_3C_2$ powder were blended in a V-blender fitted with an intensifier bar for 45 minutes. The blended powder mass was given a hydrogen treatment for 45 minutes at 1000° C. to precoat/presinter the powder mass. The powder mass was broken up in a granulator and passed through a 20 mesh screen. The blend was then reblended for a few minutes in a V-blender from which the intensifier bar was removed. Solid, cylindrically shaped blanks were then cold pressed to about 80 to 93% of the theoretical density of the Ag-$Cr_3C_2$ composition. The blanks were then infiltrated with silver by placing either a pressed disc of silver powder or solid silver, containing an excess silver volume over that required to fill the porosity in the pressed blank, on top of the blank's flat surface and the assembly was then placed in a hydrogen furnace at 1000° C. for one hour. After infiltration with silver, the contacts can be machined to desired size by conventional milling and/or turning in a lathe. Before blending it may be advantageous to add less than about 1% by weight of a ternary element such as bismuth, tellurium or thallium powder to the Ag/$Cr_xC_y$ powder blend for enhancement of the arc. In order to improve the wetting and density of the contact, it may also be advantageous to add 1 to 2% by weight of cobalt powder to the Ag/$Cr_xC_y$ powder blend.

Example 2

An improved electrical contact comprising about a nominal 50% by weight silver and 50% by weight Cr was made by the following method. 1000 grams of silver powder and 1000 grams of Cr powder were blended in a V-blender fitted with an intensifier bar for 45 minutes. The blended powder mass was given a hydrogen treatment for 45 minutes at 1000° C. to precoat/presinter the powder mass. The powder mass was broken up in a granulator and passed through a 20 mesh screen. The blend was then reblended for a few minutes in a V-blender from which the intensifier bar has been removed. Solid, cylindrically shaped blanks were then cold pressed to about 80 to 93% of the theoretical density of the Ag-Cr composition. The blanks were then infiltrated with silver by placing either a pressed disc of silver powder or solid silver, containing an excess silver volume over that required to fill the porosity in the pressed blank, on top of the blank's flat surface and the assembly was then placed in a hydrogen furnace at 1000° C. for one hour. After infiltration with silver, the contacts can be machined to desired size by conventional milling and/or turning in a lathe. Before blending, it may be advantageous to add less than about 1% by weight of a ternary element in powder from such as bismuth, tellurium or thallium for enhancement of the arc to the Ag/Cr blend. In order to improve the wetting and density of the contact, it may also be advantageous to add 1 to 2% by weight of cobalt powder to the Ag/Cr blend.

The figure shows in a photo-micrograph at 500X magnification of the silver-chromium carbide, $Ag^{-}Cr_2C_3$ contact, the microstructure made by silver infiltration of the pressed, unsintered contact. The above means of manufacturing consisting of a cold pressing and elevated temperature infiltration of silver gives an essentially 100% dense, porosity free contact microstructure which allows high current interruption.

While specific embodiments of the invention have been described in detail, it will be appreciated by those skilled in the art that various modifications and alternatives to these details could be developed in light of the overall teachings of the disclosure. Accordingly, the particular arrangements disclosed are meant to be illustrative only and not limiting to the scope of the invention, which is to be given the full breadth of the appended claims.

We claim:

1. An improved electrical contact comprising an alloy of Ag and a material selected from the group consisting of $Cr_3C_2$, $Cr_7C_3$, $Cr_{23}C_6$, mixtures thereof and Cr wherein about 0.10 to 0.99% by weight of a ternary element is selected from the group consisting of bismuth, tellurium, thallium and said ternary element is added to said alloy to enhance an arc sustaining vapor.

2. The contact of claim 1, wherein about 0.5 to 2.5% by weight of cobalt is added to said electrical composition to improve its wetting properties and enhance an essentially 100% dense, porosity tree microstructure of said contact.

3. The contact of claim 2, wherein the alloy comprises about 50 to 60% by weight Ag and about 40 to 50% by weight $Cr_3C_2$.

4. The contact of claim 3, wherein the alloy comprises about 58% by weight Ag and about 42% by weight $Cr_3C_2$.

5. The contact of claim 1, having an essentially 100% dense, porosity free microstructure derived from elevated temperature infiltration of said silver into said composition.

* * * * *